US005924926A

United States Patent [19]

Brown

[11] Patent Number: 5,924,926

[45] Date of Patent: Jul. 20, 1999

[54] GAME WAGER CONTROL SYSTEM

[76] Inventor: J. Breck Brown, 3145 E. Flamingo Rd., Las Vegas, Nev. 89121

[21] Appl. No.: 08/819,164

[22] Filed: Mar. 17, 1997

[51] Int. Cl.[6] ..... A63F 9/00; A63F 1/00

[52] U.S. Cl. ..... 463/11; 463/25; 463/27; 273/292; 273/308

[58] Field of Search ..... 463/1, 9, 12, 13, 463/16, 30–31, 36, 40–42, 26, 25; 364/410.1–412.1; 273/292, 293, 303, 309, 138.1, 139, 237, 138.2, 274; 235/1 B, 78 G, 88 G, 123

[56] References Cited

U.S. PATENT DOCUMENTS

| | | | |
|---|---|---|---|
| 3,819,186 | 6/1974 | Hinterstocker . | |
| 4,515,369 | 5/1985 | Johnson . | |
| 4,746,126 | 5/1988 | Angileri . | |
| 4,838,557 | 6/1989 | Floyhar . | |
| 4,861,041 | 8/1989 | Jones et al. . | |
| 5,078,405 | 1/1992 | Jones et al. . | |
| 5,288,077 | 2/1994 | Jones . | |
| 5,364,104 | 11/1994 | Jones et al. . | |
| 5,377,973 | 1/1995 | Jones et al. . | |
| 5,393,067 | 2/1995 | Paulsen et al. | 273/309 |
| 5,417,430 | 5/1995 | Breeding . | |
| 5,472,194 | 12/1995 | Breeding et al. . | |
| 5,490,670 | 2/1996 | Hobert | 463/20 |
| 5,536,016 | 7/1996 | Thompson . | |
| 5,544,892 | 8/1996 | Breeding . | |
| 5,570,885 | 11/1996 | Ornstein | 463/17 |
| 5,573,249 | 11/1996 | Johnson . | |
| 5,586,766 | 12/1996 | Forte et al. | 463/13 |
| 5,669,606 | 9/1997 | Brown | 273/274 |
| 5,695,192 | 12/1997 | Brown | 273/274 |

*Primary Examiner*—Jessica J. Harrison
*Assistant Examiner*—Mark A. Sager
*Attorney, Agent, or Firm*—Howard & Howard

[57] ABSTRACT

A control system for playing a game combining the play of a card game, such as blackjack or baccarat, based upon at least one card deck having fifty-two cards divided into four suites of duces through aces and the play of craps based upon two dice each having six faces numbered one to six upon which wagers are made. A game board (10) comprises an upper playing surface (12) presenting a plurality of player areas with each of the player areas including at least one craps wager indicator (20, 22, 24) having a sensor (28) for sensing the presence of a chip on a lens (27). The sensor (28) generates a sensor signal through sensor logic (36) to a register (34) which accumulates the wagers and maintains a light (30) for each indicator (20, 22, 24) illuminated after a chip is removed from the lens (27). The register (34) is connected to a keyboard (60) whereby a dealer directs the play of the game and to a table display (38) for indicating the amounts of the craps pot wagers. The register (34) also is connected to a central control (46) for coordinating the craps pot wagers with play at other similar game boards (10) and displaying the accumulated pots on a common large display (72).

8 Claims, 7 Drawing Sheets

DEALER MUST HIT-16 STAND ON 17
ACCUMULATED POT PORTIONS
10,841.00
21,686.00
3,622.00
10
14
16
18
20
22
24
34
38
40
42
44
46
72

GAME WAGER CONTROL SYSTEM

TECHNICAL FIELD

The subject invention relates to a control system for automatically sensing and accumulating wagers during the play of a combination card and dice game.

BACKGROUND OF THE INVENTION

Various games are known in the prior art which combine standard playing cards and two dice. The U.S. Pat. No. 4,746,126 to Angileri discloses a game utilizing the attributes of craps with the play of cards wherein the play of the cards is dependent upon the throw of the dice. The U.S. Pat. No. 4,515,369 discloses a game combining the elements of craps and blackjack wherein the rules of blackjack apply to movement of game pieces as determined by the roll of the dice.

There are various card games in which a wager is placed on the table by placing one or more chips on a designated spot on the gaming surface. There are various games in which a coin or chip is inserted into a slot and the wager is indicated by a light. Such systems are shown in the U.S. Pat. No. 3,819,186 to Hinterstocker; the U.S. Pat. No. 4,838,557 to Floyhar; the U.S. Pat. No. 5,536,016 to Thompson; the U.S. Pat. No. 5,364,104 to Jones et al. and the U.S. Pat. No. 5,573,249 to Johnson. In some games it is often desirable to remove the chips after the bet is made. In other words, it is often desirable for a player to place a bet, yet allow a dealer to remove the chips from the betting area while the bet remains in force during play.

Furthermore, it is known to include a progressive jackpot in a card game or other game of chance as shown in the U.S. Pat. No. 4,861,041 to Jones et al.; the U.S. Pat. No. 5,078,405 to Jones et al.; the U.S. Pat. No. 5,288,077 to Jones; the U.S. Pat. No. 5,364,104 to Jones et al.; the U.S. Pat. No. 5,377,973 to Jones et al.; the U.S. Pat. No. 5,417,430 to Breeding; the U.S. Pat. No. 5,472,194 to Breeding et al.; and the U.S. Pat. No. 5,544,893 to Jones et al.

Against this prior art background, the invention of combining the play of the card game of twenty-one, or blackjack, and the dice game of craps was made and is disclosed and claimed in the U.S. patent application Ser. No. 08/533,567, filed Sep. 25, 1995. In accordance with that invention, at least two cards are presented to each player under the rules of blackjack and a craps wager is offered to all of the players when at least one player has two cards equaling twenty-one. The craps wagers are settled based upon wagers made by the individual players and the roll of the dice generally in accordance with the odds and the rules of craps. That invention is further disclosed and claimed in the continuation-in-part application Ser. No. 08/587,016, filed Jan. 16, 1996 and now abandoned, and the continuation-in-part application Ser. No. 08/724,597, filed Sep. 30, 1996. A game board for use in playing that invention is disclosed and claimed in the U.S. patent application Ser. No. 08/, filed Jan. 22, 1997. The game board has an upper playing surface presenting a plurality of player areas with each player area including at least one wager indicator. The wager indicator is characterized by including a lens substantially flush with the playing surface and a sensor for sensing the presence of a chip on the lens.

SUMMARY OF THE INVENTION AND ADVANTAGES

The present invention concerns an apparatus for controlling wagering on a game combining the play of a card game and craps comprising; an upper playing surface presenting a plurality of player areas, a first wager indicator for each of the player areas to indicate the craps dice numbers of 7 and 11 and to produce a first wager signal in response to a wager placed thereon, a second wager indicator for each of the player areas to indicate the anti-craps dice numbers of 2, 3 and 12 and to produce a second wager signal in response to a wager placed thereon, a third wager indicator for each of the player areas to indicate the point dice numbers of 4, 5, 6, 8, 9, and 10 and to produce a third wager signal in response to a wager placed thereon, a program selector for selecting the wager magnitude mode for the device, an attract mode selector for selecting an attract mode, a play mode selector for setting play in the selected wager magnitude mode, a processor circuit for registering the wager made on each of the indicators and for providing a signal at each indicator upon which a wager was made and registered, a qualified player selector for selecting a player to roll the dice, and a win selector for selecting an indicator which matches the numbers on the roll of the dice.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
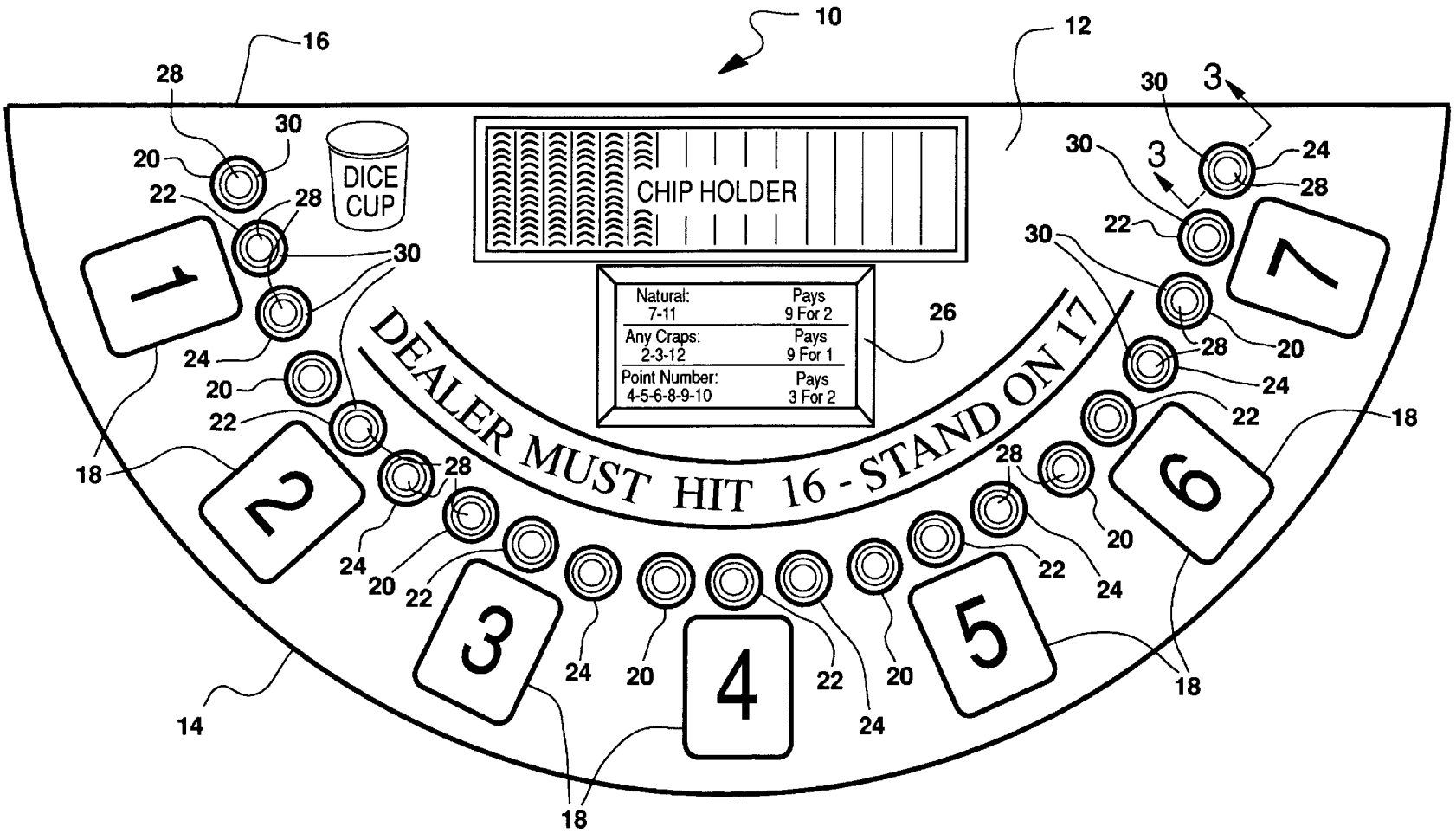
FIG. 1 is a plan view of a table top or game board associated with a game wager control according to the subject invention.

Referring to the figures, wherein like numerals indicate like or corresponding parts throughout the several views, an amusement device for combining the play of twenty-one and craps is generally shown in the FIG. 1. Although as will be appreciated as the description proceeds, the device may control any card game and craps, particularly baccarat and craps. The device takes the form of a game board, mat, table cloth or cover, place mat, or the like, and may even be implemented in a computer program producing images for a monitor. In any case the device comprises a presenter for positioning at least two cards for each player and a craps wager indicator for each player to indicate the craps wager based upon the roll of two dice by each player having only two cards equaling twenty-one.

As illustrated, the device is a game board generally indicated at 10 for combining the play of twenty-one based upon at least one card deck having fifty-two cards divided into four suites of duces through aces and the play of craps based upon two dice each having six faces numbered one to six. The board 10 comprises an upper playing surface 12 which presents a semi-circular playing arena, defined by a semi-circular periphery 14 and a straight diameter 16. A dealer playing area is disposed on the surface 12 adjacent the straight diameter 16 of the semi-circular playing arena. More specifically, the dealer playing area is in the area between the indicia portraying the chip holder and chips and the indicia indicating that the dealer must take a card on a card count of "16" and stand on a card count of "17". This is a dealer presentation area for presenting the dealer's cards.

The board 10 also defines a plurality of player areas spaced about the circumference of the semi-circular periphery 14 of the semi-circular playing arena and opposed to the dealer playing area. Each of the player areas comprises a rectangular card box 18 defining a player presentation area for each player to present the player cards. A plurality of craps wager indicators 20, 22 and 24 are disposed adjacent each player card rectangle 18 to divide the numbers 2 through 12 into a plurality of groups for wagering at different odds for each group. More specifically, a plurality of three craps wager indicators 20, 22 and 24 are presented for each player with each indicator presenting different odds for different total dice numbers. A first one 20 of the indicators represents the numerals 7 and 11, a second one 22 of the indicators represents the numerals 2, 3 and 12, and a third one 24 of the indicators presents the remaining numbers.

The game board 10 presents an odds area 26 centrally located and indicating the first, second and third odds for the respective craps wager indicators 20, 22 and 24. That is, the table pay-off odds of nine chips for two chips bet on a natural 7 or 11, the second table pay-off odds of nine chips for one chip bet on craps 2, 3 or 12, and the third table pay-off odds of three chips for two chips bet on the point numbers 4, 5, 6, 8, 9 or 10. These pay-off odds are the true odds for craps and, of course, these odds may vary as in accordance with individual house rules.

The invention, therefore, includes a method of combining the play of twenty-one and craps comprising the basic steps of presenting at least two cards to each player followed by then offering a craps wager based upon the roll of two dice to a player having two cards equaling twenty-one, i.e., to each player having a blackjack. Each player having blackjack and beating the dealer then places a craps wager and rolls the dice; the wagers are then settled based upon the outcome of the roll of the dice. The offering of the craps wager includes the offer of a plurality of alternative dice number combinations in groups having different betting odds. More specifically, the offering of the wager combinations are divided into the dice number combinations of the natural 7 or 11 at first odds, the dice number combinations of any craps 2, 3 or 12 at second odds, and the remaining dice number combinations of the point numbers 4, 5, 6, 8, 9, or 10 at different third odds.

The play of twenty-one is based upon at least one card deck having fifty-two cards divided into four suites of duces through aces and the play of craps is based upon two dice each having six faces numbered one to six. It involves the placing of a blackjack wager on behalf of each player to beat a dealer player by placing chips in front of the card boxes 18. The dealer, or a dealing machine, presents two cards to each player including the dealer player by placing the cards on the card boxes 18 in sequence about the semi-circular periphery 14 and in the dealer playing area. As is normal in the game of blackjack, additional cards are sequentially presented to each player in response to a request for same from that player. Thereafter, the blackjack wagers are paid or settled in the absence of requests for additional cards. The opportunity or option to roll two dice is then presented to each player beating the dealer player with a blackjack consisting of only two cards equaling twenty-one. However, before the roll of the dice, each player establishes a craps wager, if the player wishes to participate, based upon the roll of the two dice by placing chips on one of the three circular craps wager indicators 20, 22, or 24 to indicate the numbers and odds of the roll. The blackjack winner then rolls the dice once and each craps wager is settled based upon the outcome of the roll of the dice.

Accordingly, at one seating a player may play blackjack and qualify to further bet on a craps roll of the dice each time a player is dealt a blackjack.

An accumulated pot variation may be combined with or substituted for the wager entitlement which occurs upon a player having two cards equaling twenty-one. In either case, the two are completely independent as the wagers on the accumulated pot are accumulated separately and paid out on independent criteria. However, in the preferred embodiment, the accumulated pot is played along with or in conjunction with the craps wager entitlement. More specifically, the accumulated pot variation is played by offering an accumulative pot wager based upon the roll of two dice prior to presenting the cards to the players. In other words, the entire game is initiated by each player placing a pot wager on one or more of the craps wager indicators 20, 22 and 24.

Figure 3:
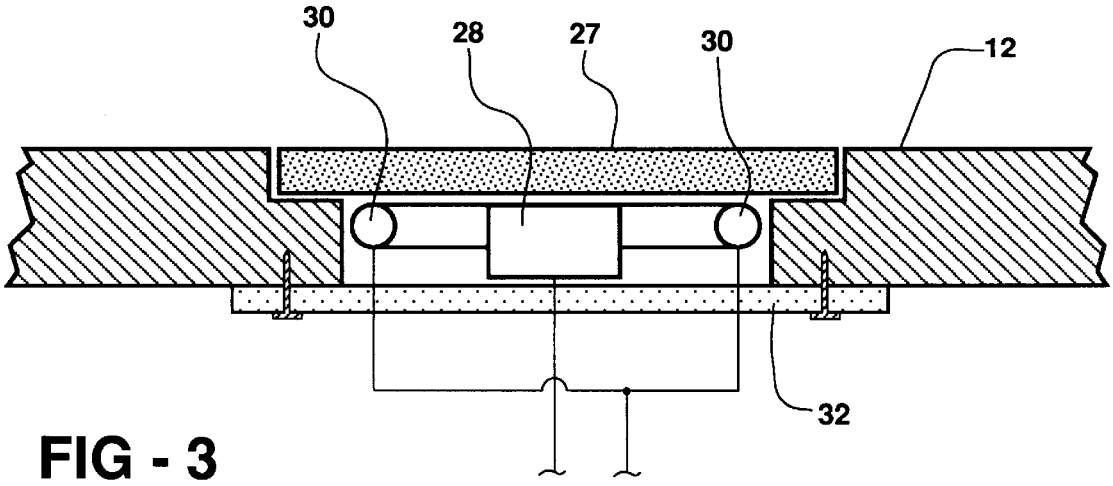
FIG. 3 is an enlarged fragmentary view of a sensor taken along the line 3—3 of the FIG. 1.

As shown in the FIG. 3, each craps wager indicator 20, 22 and 24 can include a lens 27 substantially flush with said playing surface, i.e., the upper surface of the lens is flush enough with the upper surface 12 of the game board 10 to prevent cards from hanging up or being prevented from sliding over the lens. A sensor 28 is included for sensing the presence of a chip on the lens 27. The lens 27 is clear or opaque to allow light to pass through and the sensor 28 senses the absence of such light when a chip covers the center of the lens 27. Each sensor 28 comprises a photocell supported centrally under each lens 27 by a bracket 32 secured to the bottom of the table or board 10.

Each craps wager indicator 20, 22 and 24 also includes a light 30 for indicating that a wager has been placed on the lens 27 of the wager indicator. The light 30 surrounds the sensor 28 under each lens 27 and comprises at least one light emitting diode. As illustrated, each lens 27 is circular and each light 30 can be formed by a plurality of light emitting diodes (LED's) disposed about the circumference of the circular lens 27 and around the sensor 28 in the middle of that lens. Each light 30 includes a tube of light with a longitudinal axis disposed in a circle about the circumference of the lens 27 and around the sensor 28. The LED's may be equally spaced within the tube or the tube may be of the florescent type. In addition, the lights are of a plurality of colors, e.g., each indictor may be of a different color or each indicator may include a plurality of diodes each of a different color.

Figure 2:
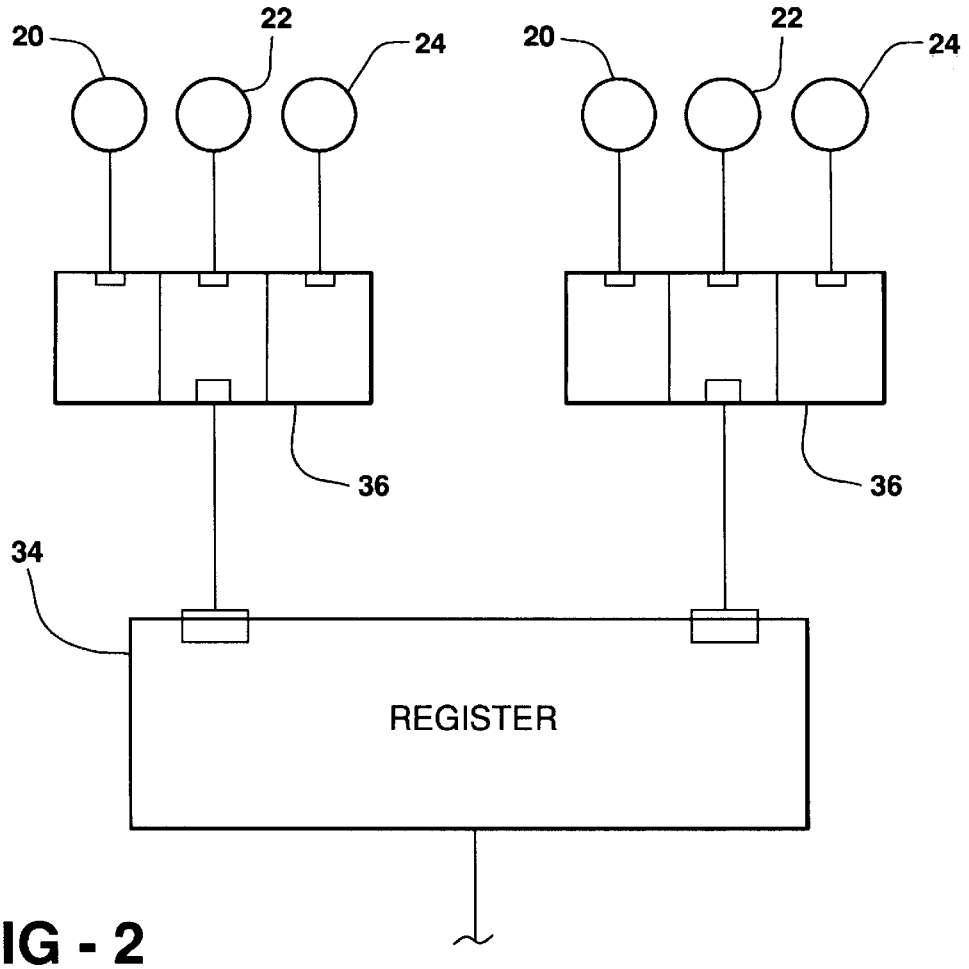
FIG. 2 is a schematic block diagram of a portion of the control system associated with game board of the FIG. 1.

As shown in the FIG. 2, the accumulated pot system includes a register 34 for storing the pot wager placed by each player upon the craps wager indicators 20, 22 and 24, i.e., the register 34 will indicate the one or ones of the three craps wager indicators 20, 22 and 24 upon which each player has placed a pot wager. In addition to the register 34, each craps wager indicator 20, 22 and 24 has the sensor 28 for electronically counting the chip wagered on the pot with the indicator light 30 to indicate the associated craps wager indicator upon which a chip was wagered. More specifically, a switching device 36 is disposed between each group of indicators for each player and the register 34 for passing a sensor signal to the register 34 to indicate the presence or absence of a chip and for switching the light 30 on when the sensor 28 associated therewith senses a chip and maintains that light in the on or illuminated condition after the dealer removes the chips from the table. In other words, the switching device 36 maintains the light 30 for each indicator illuminated after the chip is removed from the lens 27 and during the play of blackjack until play is over or a player becomes qualified by being dealt a predetermined blackjack, in which case, that qualified player rolls the dice for the accumulated pot or pots upon which the player initially placed a wager.

The game proceeds as described above with the craps wager indicators 20, 22 and 24 used by the players to place wagers in the event one of the players gets twenty-one. Successive hands are dealt and played while accumulating the pot wagers without payout until a player becomes a qualified player by having two cards of a predetermined combination to make a predetermined blackjack equaling twenty-one. In other words, when a player receives a predetermined blackjack, e.g., a predetermined combination of an Ace and a Jack of the same suit or different suits, or specifically the Ace of hearts and the Jack of spades, that player becomes a qualified player eligible to win a portion of the accumulated pot. The register 34 has retained the count as to which indicators each player has placed an accumulated pot wager; thus, accumulating the total in each accumulated pot from hand to hand. The lights 30 indicate the wagers and signify that the qualified player with the predetermined blackjack may roll the dice for that particular accumulated pot.

The qualified player rolls the dice to match his initial pot wager placed at the beginning of the game and which the register light 30 has indicated throughout the play. If the player placed wagers on more than one indicator, the player rolls the dice once for each different indicator upon which the player placed a wager. Accordingly, all or at least a portion of the accumulated pot is paid out to the qualified player in response to the registered pot wager by the qualified player covering the outcome of the roll of the dice. That is, the accumulated pot is paid to the player if the roll of the dice for a certain indicator matches any of the numbers in that indicator. The accumulated pot is divided into three different payout portions each corresponding to one of the craps wager indicators 20, 22 and 24. Hence, the pot wager is made on the dice number combinations of 2, 3 and 12 at the greatest payout portion and dice number combinations of 7 and 11 at a lesser payout portion and the remaining dice number combinations at the smallest payout portion.

Figure 4:
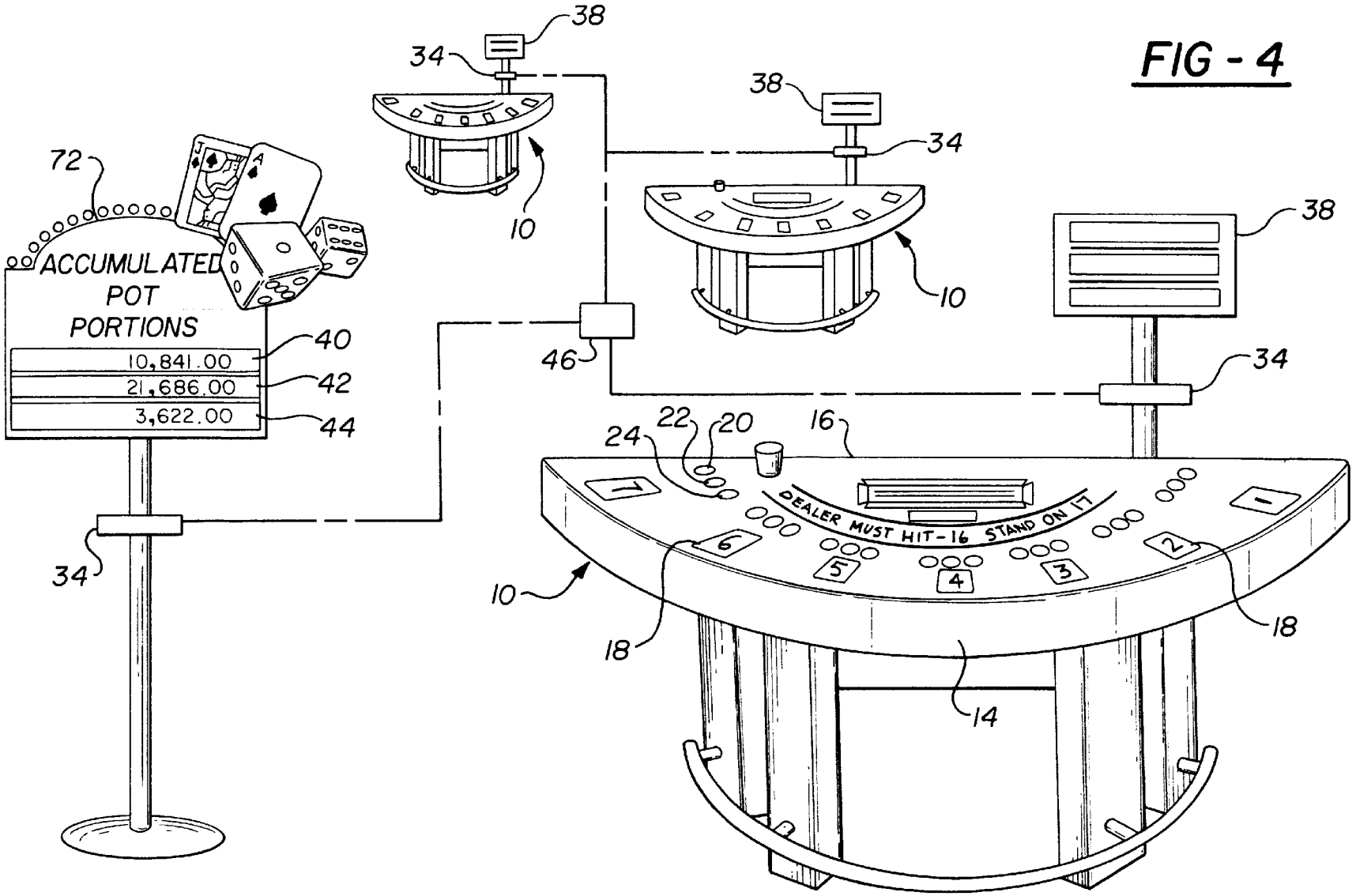
FIG. 4 shows a plurality of playing tables networked together, each table incorporating the components shown in the FIG. 1 through the FIG. 3.

To further enhance the game by increasing the accumulated pot faster and to higher amounts, as shown in the FIG. 4 a plurality of playing sites, i.e., individual tables each with its own game board 10 and dealer, may be combined electronically to establish one common combined pot. This common combined pot is divided into three portions, each of which is paid out to the first player having the winning combination of a predetermined blackjack and rolling the dice to match his registered pot wager. Otherwise, the pot wagers are accumulated without payout from hand to hand until a qualified craps player has the predetermined winning combination. The pot wagers placed on the respective craps wager indicators 20, 22 and 24 may be accumulated separately, i.e., individually, to establish independent posted portions on an electronic table display sign 38 for each table 10 which may vary from time to time in proportion to the number of wagers in each craps wager indicator 20, 22 and 24 and/or the lack of winning players in one or two pot portions. After a win, that portion of the pot may be seeded to start a new series of hands.

Accordingly, at one seating a player may play blackjack and qualify to further bet on a craps roll of the dice each time the player receives a blackjack, and, in addition, to place pot wagers to qualify for rolling the dice for the pot in the event of receiving a predetermined blackjack, such as the Ace and Jack of one designated combination. Alternatively, the present invention may interleave the pot wager with similar card games which are played from hand to hand under conventional rules until a player qualifies to roll the dice for at least a portion of the pot by beating the dealer in the card game with a predetermined combination of cards which is generally more difficult to acquire than lesser winning combinations and then follows up with a roll of the dice producing numbers in the group of numbers the player wagered upon in the pot wager at the beginning of the hand.

As the respective accumulated pots increase from hand to hand because no player becomes a winning qualified pot player, or, if so, does not roll a number on the dice which matches a number in the indicator area upon which that player placed an accumulative pot wager, the three accumulated pot amounts are displayed by the table display sign 38. The table display sign 38 includes a first electronic display 40 on which is posted the payout of the first accumulated pot to the winning qualified player in response to the numbers resulting from the roll of the dice by the winning qualified player matching one of the numbers in the first craps wager indicator 20 upon which the winning qualified player placed a first accumulative pot wager. The table display sign 38 also includes a second electronic display 42 for posting the payout of the second accumulated pot to the winning qualified player in response to the numbers resulting from the roll of the dice by the winning qualified player to matching one of the numbers in the second craps wager indicator 22 upon which the winning qualified player placed a second accumulative pot wager and includes a third electronic display 44 for posting the payout of the third accumulated pot to the winning qualified player in response to the numbers resulting from the roll of the dice by the winning qualified player matching one of the numbers in the third craps wager indicator 24 upon which the winning qualified player placed a third accumulative pot wager. The displays 40, 42 and 44 associated with each table display sign 38 are connected to an associated one of the registers 34 for receiving information representing the accumulated pot amounts to be displayed. Each of the registers 34 can be connected to a central control 46 for adding together the corresponding accumulated pot amounts from all of the tables and posting the common combined pot amounts on the displays 40, 42 and 44 of each of the table signs 38.

Various means can be provided for playing the game described above. For example, the dice rolling means for playing craps could be a cup, a closed and clear walled container for rolling the dice within the container, cards having a dice number on each of at least twelve cards, or a computerized or mechanized device for randomly selecting the dice number. Similarly, the cards for playing blackjack could be a computerized or mechanized device for randomly selecting the cards. Also, the playing surface 12 could be generated on one or more computer screens and the placing of a chip can be replaced by utilizing touch screen technology to sense the touching craps wager indicator areas on the screen.

Figure 5:
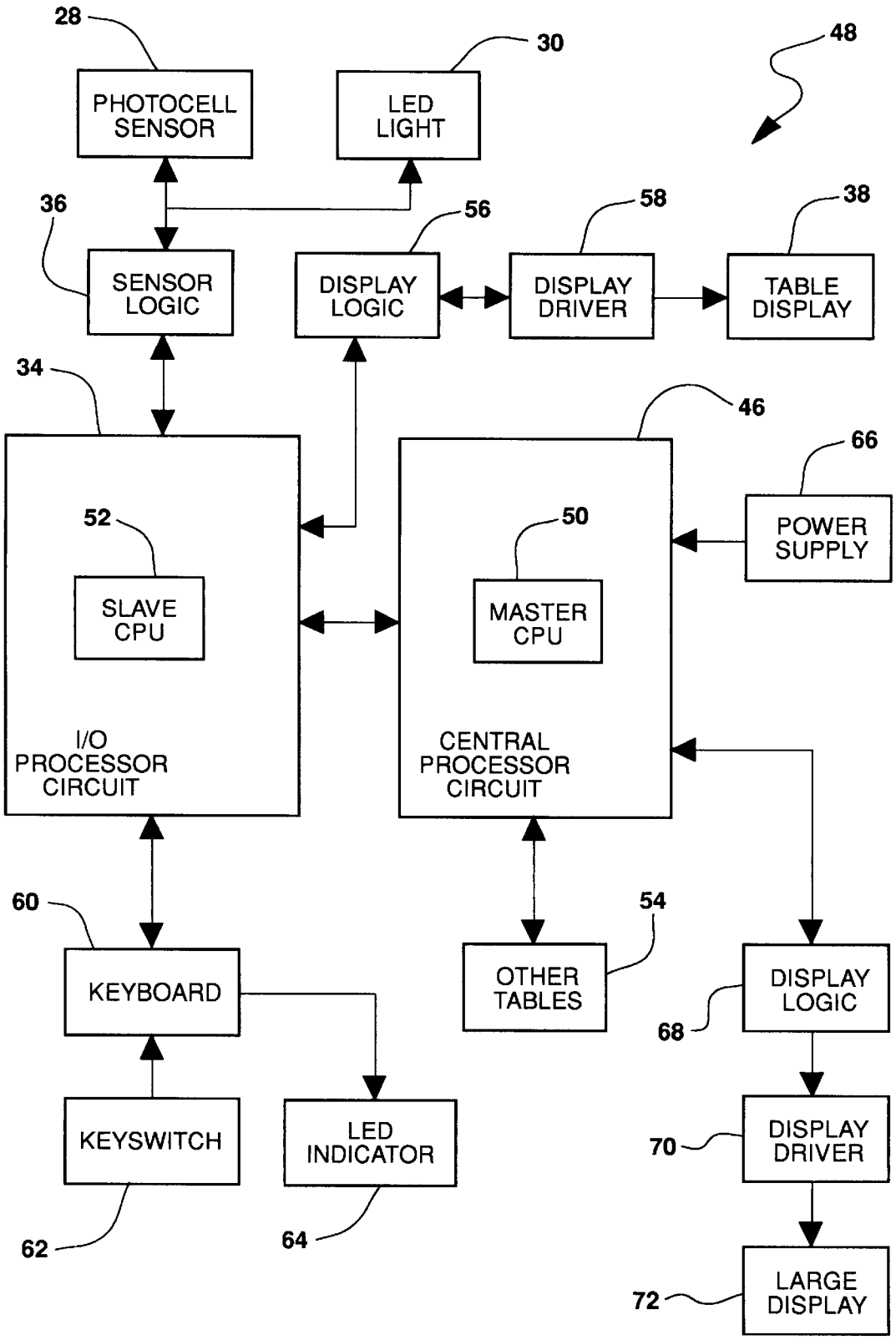
FIG. 5 is a schematic block diagram of a game wager control system for the networked playing tables shown in the FIG. 4.

A control system 48 is shown in the FIG. 5 for facilitating interaction between the dealer and the players at each of the tables 10 shown in the FIG. 4 and for coordinating the play among the networked tables. The central control 46 can be a central processor circuit which includes a master CPU (central processing unit) 50. The central control 46 is connected to one of the registers 34 which can be an I/O processor circuit having a slave CPU 52. Thus, the master CPU 50 and the slave CPU 52 are connected together for exchanging information and control signals as discussed below. The central control 46 is connected in a similar manner to the registers 34 at an other tables block 54 which represents the second and third tables 10 shown in the FIG. 4 and additional such tables as desired. The registers 34 and the central control 46 shown in the FIG. 4 typically are mounted underneath the upper playing surfaces 12 of the tables 10. Furthermore, each of the tables 10 can be provided with one of the central controls 46 for stand alone play and, when two or more of the central controls are connected together for accumulating pots from two or more such tables, one of the central controls can be operated as the server for the network of tables.

The slave CPU 52 is connected through the sensor logic 36 to the photocell sensors 28 and LED lights 30. The photocell sensor 28 and the LED light 30 shown in the FIG. 5 are representative of three such sets connected to the sensor logic 36 which in turn is representative of seven such logic circuits, one for each of the seven player positions at the table 10. The slave CPU 52 also is connected to a display logic circuit 56. A display driver 58 is connected between the display logic circuit 56 and the table display sign 38. The slave CPU 52 also is connected to a keyboard 60 having a key switch 62 connected to an input thereof and having an output connected to an LED indicator 64. The keyboard 60 is used by the dealer during the playing of the game and the keyboard switch 62 is used by the dealer to select a mode of operation for the I/O processor circuit 34 as described below.

Electrical power is provided for all of the circuits of the control system 48 by a power supply 66 connected to the central processor circuit 46. The central processor circuit 46 distributes power throughout the control system 48. The central processor circuit 46 also is connected to a display logic circuit 68. A display driver 70 is connected between the display logic circuit 68 and a large display sign 72 which is similar to the table display signs 38. As shown in the FIG. 4, the large display sign 72 can be positioned so that it can be seen by players at all of the tables 10 and can include electronic displays for displaying the pots at each of the tables and/or a total pot representing the accumulating pots from all of the tables.

Figure 6:
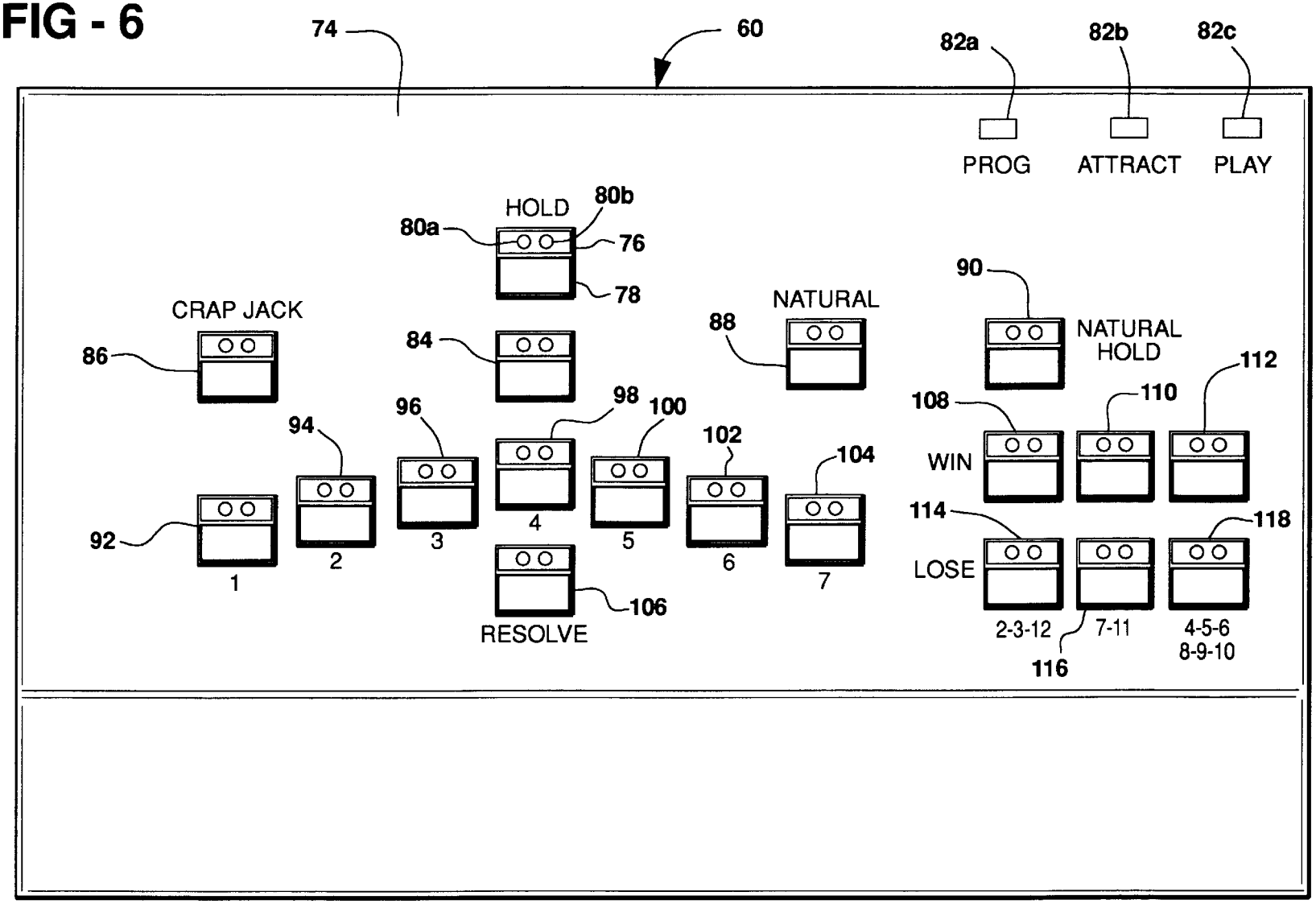
FIG. 6 is a plan view of the keyboard shown in the FIG. 5.

The keyboard 60 is shown in more detail in the FIG. 6. The keyboard 60 includes a panel 74 having a plurality of push button/indicator units mounted thereon. For example, a HOLD push button/indicator unit 76 includes a lower push button 78 for manual actuation by the dealer to close a momentary contact switch (not shown) for generating the hold signal from the keyboard 60 to the slave CPU 52. Positioned in an upper left portion of the unit 76 is a first LED indicator light 80*a* which can be of a suitable color such as green. Positioned in an upper right portion of the unit 76 is a second LED indicator light 80*b* which can be of a suitable color such as red. The first indicator light 80*a* is lighted to signal the dealer when the push button switch is ready to be actuated and the second indicator light 80*b* is lighted to signal the dealer when the push button switch has been actuated.

Positioned in an upper right corner of the panel 74 is a row of three LED indicators; a PROG indicator 82*a*, an ATTRACT indicator 82*b* and a PLAY indicator 82*c*. The keyswitch 62 includes manually actuatable positions for selecting one of a program mode, an attract mode and a play mode of operation. The indicators 82*a*, 82*b* and 82*c* are lighted to indicate the status of the keyswitch 62.

Positioned below the HOLD unit 76 is a NEXT push button/indicator unit 84. Positioned to the left of the unit 84 is a CRAPJACK push button/indicator unit 86. Positioned to the right of the unit 84 is a NATURAL push button/indicator unit 88 and a NATURAL HOLD push button/indicator unit 90 is positioned to the right thereof. Positioned below the above described units in a generally arcuate row, are seven push button/indicator units each representing one of the seven players at the table 10. The units are from left to right: PLAYER 1 92, PLAYER 2 94, PLAYER 3 96, PLAYER 4 98, PLAYER 5 100, PLAYER 6 102 and PLAYER 7 104. Below the PLAYER 4 unit 98 is a RESOLVE push button/indicator unit 106. To the right of the PLAYER 7 unit 104, there is an upper row of three WIN push button/indicator units 108, 110 and 112 and a lower row of three LOSE push button/indicator units 114, 116 and 118. The units 108 and 114 represent the any craps points of 2, 3 and 12. The units 110 and 116 represent the natural craps combinations of 7 and 11. The units 112 and 118 represent the point number craps combinations of 4-5-6 and 8-9-10. The units 84 through 118 are similar in design to the unit 76 including a push button switch and two indicator LEDs.

When the keyswitch 62 of FIG. 5 is in the program mode position, the indicator 80*a* is lighted and a program signal is generated to the circuit 34. The central processor circuit 46 is provided with an I/O port 47 (FIG. 5) to which a programming device can be connected such as a portable computer (not shown) for inputting data. The dealer can use the programming device to select any of several different games to be played and/or different progressives at the table. For example, the players can play with one dollar chips during one game and can play with five dollar chips during another game at the same table. The I/O port 47 also can be used to generate data to a portable computer or a main frame computer to gather information about the games being played. The game data can be stored in the central processor circuit 46 and gathered periodically or can be transferred in real time as the games are played.

When the keyswitch 62 of FIG. 5 is in the attract mode position, the indicator 80*b* is lighted and an attract signal is generated to the circuit 34. The circuit 34 responds to the attract signal by generating flash signals for flashing some or all of the lights 30 connected thereto in a predetermined manner. The flashing can be random or in a pattern and is designed to attract players to the table. The circuit 34 also can generate signals to flash the table display 38 and/or display messages also designed to attract players to the table. In addition, the central control 46 can generate signals to flash the large display 72 and/or display messages also designed to attract players to the tables.

When the keyswitch 62 of FIG. 5 is in the play mode position, the indicator 80*c* is lighted and the method of operation of the control system 48 shown in the FIG. 5 is described below in connection with the flow diagram shown in the FIG. 7 and the FIG. 8. The method starts at a circle ON 120 and enters an instruction set PLACE BET, SENSE CHIP 122. As previously described, each of the players can place bets by putting a chip on one or more of the craps indicators 20, 22 and 24. The associated sensor 28 generates a wager sensor signal representing the blockage of incident light by the chip which sensor signal is processed through the sensor logic circuit 36 and into the slave CPU 52. Once the bets have been placed, the dealer presses the HOLD push button 78 which generates a hold signal causing the slave CPU 52 to enter an instruction set PRESS HOLD, SHOW BET 124. The dealer then sweeps the chips from the table while the slave CPU 52 generates signals through the sensor logic circuit 36 to light the LED lights 30 corresponding to the indicator positions at which wager chips have been placed. The slave CPU 52 also generates display control signals through the display logic circuit 56 to refresh the display driver 58 and update the table display 38 to include the just placed bets in the pots. The sensor logic circuit 36 maintains the activated LED lights 30 on until being reset by the slave CPU 52. The dealer then deals a hand of the card game black jack and evaluates the results at an EVAL decision point 126. If there is no black jack, an instruction set NO BJ PRESS NEXT HAND 128 is entered by the dealer pressing the push button of the NEXT unit 84. The slave CPU 52 senses the actuated push button associated with the unit 84 and responds by turning off all of the lighted LED lights 30 through the associated sensor logic circuits 36. The method then returns to the instruction set 122 where the players again place bets.

If one or more of the players has a predetermined black jack hand at the EVAL decision point 126, a "trigger" or winning hand, the dealer presses the CRAPJACK unit 86 push button and the slave CPU 52 enters an instruction set TRIGGER PRESS CJ 130 to sense the actuated push button of the unit 86, i.e., a selection of a qualified player. The dealer then qualifies a player having a "trigger" or winning hand and a wager by pressing the corresponding one of the push buttons of the PLAYER units 92 through 104. The dealer then presses the push button of the RESOLVE unit 106 to log the qualified player into the slave CPU 52. The slave CPU 52 senses the actuated player push button in an instruction set PRESS QUALIFY 132. The slave CPU 52 then enters an instruction set LIGHT WIN/LOSE BUTTONS 134 wherein the appropriate LEDs above the push buttons in the units 108 through 118 are lighted for the first player to play. When playing the game baccarat, the qualified players can be selected randomly by a random number generator in the processor circuit 34,46. The method of operation exits the FIG. 7 at a circle 136 and enters the FIG. 8 at that circle. The qualified player rolls the dice and the dealer determines whether that player wins at a decision point WIN? 138. If the player has won a wager, the dealer presses the push button of the appropriate WIN unit 108 through 112. Similarly, if the wager is lost, the dealer presses the push button of the corresponding LOSE unit 114 through 118. The dealer presses the push button of the RESOLVE unit 106 and the slave CPU 52 senses actuation of the push buttons in an instruction set PRESS WIN 140 and an instruction set PRESS LOSE 142. The slave CPU 52 then determines whether the player bet on any other pots at a decision point POTS? 144. If there is another pot, the slave CPU 52 enters an instruction set NEXT POT 146 and the method of operation exits the FIG. 8 at the circle 148 to enter at the same circle in the FIG. 7 prior to the instruction set 134.

When the first player has played all of the pots to which he is entitled, the method branches from the decision point 144 to a decision point 150 where it is determined if there are any more qualified players. If there are additional qualifying players, the operation branches to an instruction set NEXT PLAYER 152 and moves from the FIG. 8 to the FIG. 7 at the circle 148. If there are no other qualifying players, the method branches from the decision 150 to an instruction set PLAY OUT HANDS 154 wherein all of the natural black jacks, including "trigger" hands, are played out. The method exits the FIG. 8 at a circle 156 and enters the FIG. 7 thereat. The method continues when an instruction set NAT BJ, NO TRIGGER PRESS NAT 158. The instruction set 158 is also entered from a decision point 126 when there is at least one natural black jack but no "trigger" hand. The dealer presses the push button of the NATURAL unit 88 to signal the slave CPU 52 to sense bets. The players place chips on the sensors 28 and the slave CPU 52 senses the presence of the chips in an instruction set PLACE BET SENSE CHIP 160. The dealer presses the push button of the NATURAL HOLD unit 90 and sweeps the chips from the table while the slave CPU 52 keeps lighted the LED lights 30 corresponding to the placed bets. The slave CPU 52 senses the actuated push button of the unit 90 and continues to show the bets in an instruction set PRESS NAT HOLD SHOW BET 162.

Figure 7:
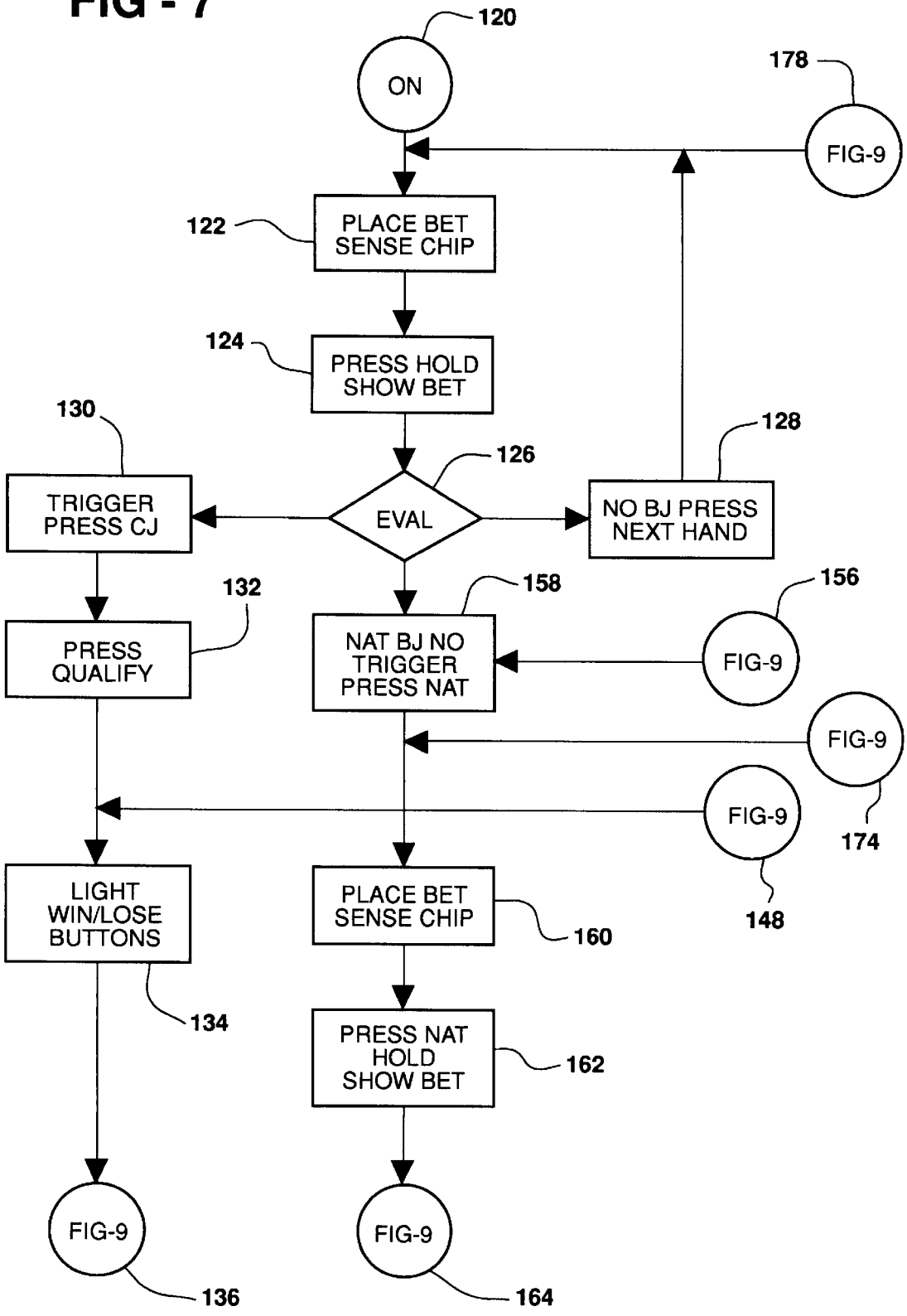
FIG. 7 and FIG. 8 are a flow diagram of the method of operation of the control system shown in the FIG. 5.
Figure 8:
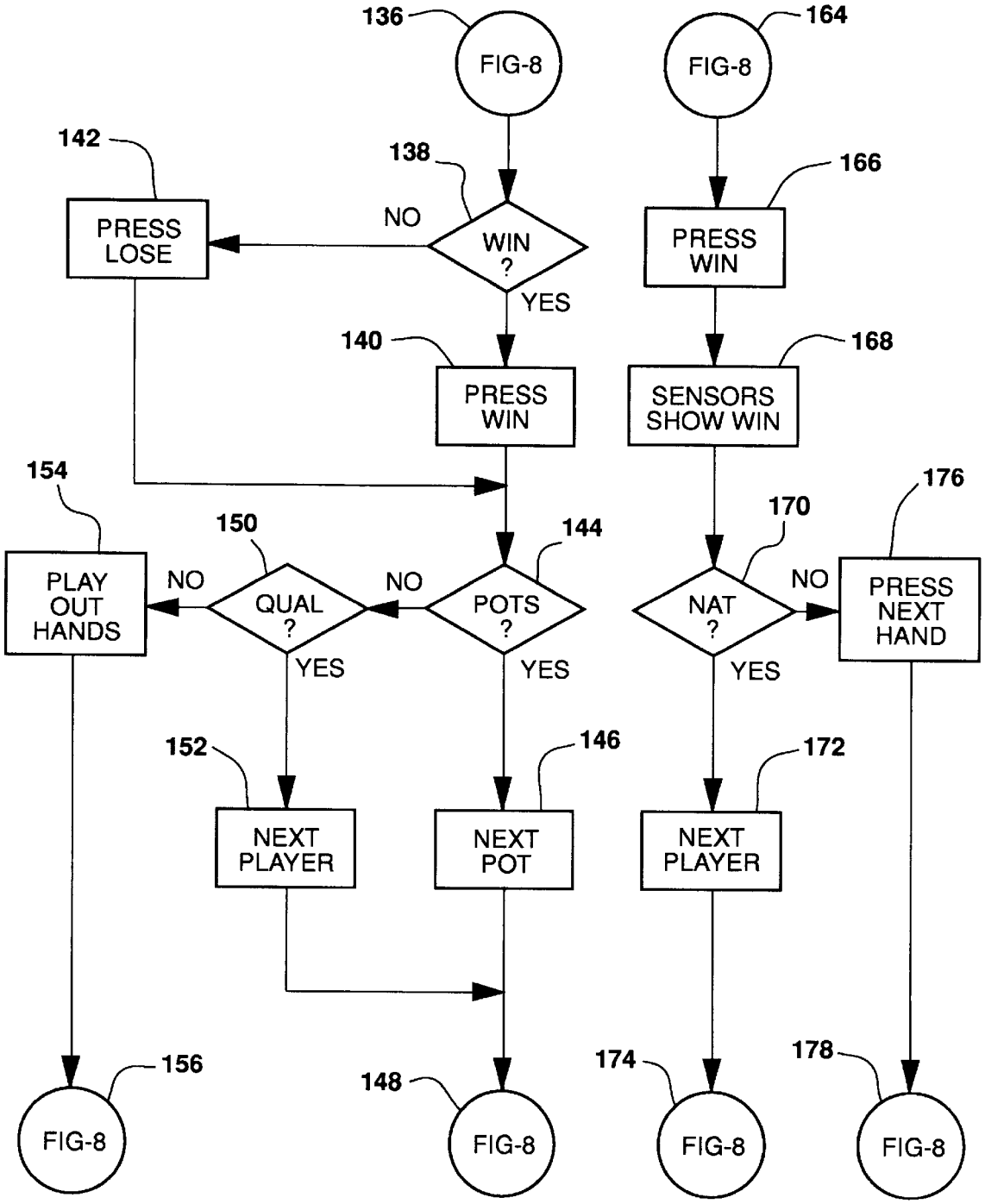

The method moves from the FIG. 7 to the FIG. 8 at a circle 164. The player with the first black jack rolls the dice and the dealer presses the WIN push button corresponding to the dice roll which actuated push button is sensed by the slave CPU 52 in an instruction set PRESS WIN 166. The slave CPU 52 activates the LED lights 30 to show the appropriate winning bets with an instruction set SENSORS SHOW WIN 168. The method enters a decision point NAT? 170 so that the dealer can determine whether there are any more players with natural black jacks. If there are additional such players, the method enters an instruction set NEXT PLAYER 172 and moves from the FIG. 8 to the FIG. 7 at a circle 174. If there are no additional players having natural black jack hands, the method branches from a decision point 170 to an instruction set PRESS NEXT HAND 176 where the dealer presses the push button of the NEXT unit 84 and the method exits the FIG. 8 at a circle 178 to enter the FIG. 7. The slave CPU 52 is now ready to enter the instruction set 122 at the beginning of the next hand.

In summary, the control system 48 according to the present invention concerns an apparatus for controlling wagering on a game combining the play of twenty-one based upon at least one card deck having fifty-two cards divided into four suites of duces through aces and the play of craps based upon two dice each having six faces numbered one to six. The control system 48 is used with the game board 10 having the upper playing surface 12 presenting a plurality of player areas. Each of the player areas 12 includes at least one of the wager indicators 20,22,24 having the sensor 28 responsive to incident light and for generating the sensor signal when a chip representing a pot wager is placed on the wager indicator blocking the incident light. The processor circuit means 34,46 is connected to the wager indicators 20,22,24 and is responsive to the sensor signals for automatically accumulating the pot wagers and generating the display control signal representing the amount of the accumulated pot. The table display means 38 is connected to the processor circuit means 34,46 and is responsive to the display control signal for generating the visual indication of the accumulated pot amount. The wage indicators 20,22,24 include the light 30 responsive to the light signal for indicating that a wager has been placed on the wager indicator and the processor circuit means 34,46 generates the light signal in response to receiving the sensor signal. The switching device 36 is connected between the light 30 and the processor circuit means 34,46 and is responsive to the hold signal for maintaining the light for each wager indicator 20,22,24 illuminated after a chip is removed from the wager indicator. The keyboard 60 is connected to the processor circuit means 34,46 for generating the hold signal in response to actuation by a dealer. The keyswitch 62 is connected to the processor circuit means 34,46 for generating the attract mode signal and the processor circuit means is activated by the attract mode signal for generating the flash signal to flash the light 30 and/or the visual indication generated by the table display means 38. The keyswitch 62 generates the play mode signal to activate the processor circuit means to respond to the sensor signals for automatically accumulating the pot wagers and generating the display control signal. The keyswitch 62 also generates the program mode signal to activate the processor circuit means to respond to data received at the port 47 of the processor circuit means for setting a wager value associated with each of the wager indicators 20,22,24. The processor circuit means 34,46 is connected to at least one other such processor circuit means at another one of the tables 10 for accumulating pot wagers at both of the tables.

Although the invention has been described in connection with a game combining craps and blackjack, it may be used effectively with any card game where wagers are placed upon a table, e.g., poker, baccarat, and the like.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A device for combining the play of a card game and craps comprising;

an upper playing surface (12) presenting a plurality of player areas, a first wager indicator (20) for each of said player areas to indicate the craps dice numbers of 7 and 11 and to produce a first wager signal in response to a wager placed thereon, a second wager indicator (22) for each of said player areas to indicate the anti-craps dice numbers of 2, 3 and 12 and to produce a second wager signal in response to a wager placed thereon, a third wager indicator (24) for each of said player areas to indicate the point dice numbers of 4, 5, 6, 8, 9, and 10 and to produce a third wager signal in response to a wager placed thereon, a program selector **(82*a*) for selecting a wager magnitude mode for the device, an attract mode selector (82*b*) for selecting an attract mode, a play mode selector (82*c*) for setting play in the selected wager magnitude mode, a processor circuit (34,46) for registering the wager made on each of said indicators (20, 22, 24) and for providing a sensor signal at each indicator (20, 22, 24) upon which a wager was made and registered, a qualified player selector (92–104) for selecting a player to roll a pair of dice, and a win selector (108–112) for selecting an indicator (20, 22, 24)** which matches the numbers on the dice after the roll.

2. The apparatus according to claim 1 wherein said wage indicators (20,22,24) include a light (30) responsive to a light signal for indicating that a wager has been placed on said wager indicator, said processor circuit means (34,46) generating said light signal in response to receiving said sensor signal.

3. The apparatus according to claim 2 including a switching device (36) connected between said light (30) and said processor circuit means (34,46) and being responsive to a hold signal for maintaining said light for each wager indicator (20,22,24) illuminated after a chip is removed from said wager indicator and including a keyboard (60) connected to said processor circuit means for generating said hold signal in response to actuation by a dealer.

4. The apparatus according to claim 1 including a keyswitch (62) connected to said processor circuit means (34, 46) for generating an attract mode signal, said processor circuit means being activated by said attract mode signal for generating a flash signal to flash said visual indication generated by said table display means (38).

5. The apparatus according to claim 1 including a keyswitch (62) connected to said processor circuit means (34, 46) for generating an attract mode signal, wherein said wage indicators (20,22,24) include a light (30) and said processor circuit means is activated by said attract mode signal for generating a flash signal to flash at least one of said light and said visual indication generated by said table display means (38).

6. The apparatus according to claim 1 including a keyswitch (62) connected to said processor circuit means (34, 46) for generating a play mode signal, said processor circuit means being activated by said play mode signal to respond to said sensor signals for automatically accumulating the wagers and generating said display control signal.

7. The apparatus according to claim 1 including a keyswitch (62) connected to said processor circuit means (34, 46) for generating a program mode signal, said processor circuit means being activated by said program mode signal to respond to data received at a port (47) of said processor circuit means for setting a wager value associated with each of said wager indicators (20,22,24).

8. The apparatus according to claim 1 wherein said processor circuit means (34,46) is connected to at least one other such processor circuit means at another one of said tables (10) for accumulating pot wagers at both said tables.

* * * * *